US007800980B2

(12) United States Patent
Busch et al.

(10) Patent No.: US 7,800,980 B2
(45) Date of Patent: Sep. 21, 2010

(54) ELECTROACOUSTIC UNDERWATER ANTENNA

(75) Inventors: Rainer Busch, Oldenburg (DE); Axel Brenner, Bremen (DE)

(73) Assignee: Atlas Elektronik GmbH, Bremen (DE)

( * ) Notice: Subject to any disclaimer, the term of this patent is extended or adjusted under 35 U.S.C. 154(b) by 649 days.

(21) Appl. No.: 11/658,868

(22) PCT Filed: Jun. 15, 2005

(86) PCT No.: PCT/EP2005/006382

§ 371 (c)(1),
(2), (4) Date: Jan. 30, 2007

(87) PCT Pub. No.: WO2006/015645

PCT Pub. Date: Feb. 16, 2006

(65) Prior Publication Data

US 2009/0190442 A1 Jul. 30, 2009

(30) Foreign Application Priority Data

Aug. 5, 2004 (DE) ..... 10 2004 037 987

(51) Int. Cl.
*G10K 11/00* (2006.01)

(52) U.S. Cl. ..... 367/153; 367/173

(58) Field of Classification Search ..... 367/153–155, 367/173

See application file for complete search history.

(56) References Cited

U.S. PATENT DOCUMENTS 3,781,781 A * 12/1973 Groves, Jr. ..... 367/155
3,907,062 A 9/1975 Brigham et al.
4,158,189 A * 6/1979 Wardle ..... 367/153
5,499,219 A 3/1996 Brenner et al.
5,517,467 A * 5/1996 Fromont et al. ..... 367/155
7,180,828 B1 * 2/2007 Sommer et al. ..... 367/154

FOREIGN PATENT DOCUMENTS

| | | | |
|---|---|---|---|
| DE | 195 18 461 | C1 | 6/1996 |
| DE | 38 34 669 | A1 | 7/1996 |
| DE | 198 12 356 | C1 | 10/1999 |
| DE | 101 28 973 | C1 | 7/2002 |
| EP | 0 214 525 | A1 | 3/1987 |
| EP | 0 615 900 | A1 | 9/1994 |
| EP | 0 654 953 | A1 | 5/1995 |

* cited by examiner

*Primary Examiner*—Ian J Lobo
(74) *Attorney, Agent, or Firm*—Fitch, Even, Tabin & Flannery; Norman N. Kunitz

(57) ABSTRACT

An electroacoustic underwater antenna, particularly a lateral antenna which can be fixed to the outer hull of an underwater craft, comprising a series of hydrophones (13) successively arranged in at least one elongate, closed, oil-filled cavity at a distance from each other. The aim of the invention is to achieve a high degree of reception sensitivity in the low frequency range with a sufficiently small, vertical aperture angle. The inventive device is easy to produce and mount and is characterized by several cavities (14) which are fitted with hydrophones (13) at a parallel distance from each other, arranged in front of a rigid plate (12) at a distance therefrom. The plate (12) and the cavities (14) are formed in a panel-type, acoustically transparent plastic element (11). Several of said plastic elements (11) are arranged close to each other or behind each other.

9 Claims, 2 Drawing Sheets

ELECTROACOUSTIC UNDERWATER ANTENNA

CROSS REFERENCE TO RELATED APPLICATION

This Application is a U.S. Utility Patent Application filing under section 371 of International Patent Application PCT/EP2005/006382, filed Jun. 15, 2005, and claims priority from German Application No. 10 2004 037 987.4, filed Aug. 5, 2004, the complete disclosures of which are incorporated herein by reference.

BACKGROUND OF THE INVENTION

The invention relates to an electroacoustic underwater antenna, in particular side antennas which can be fitted to the outer skin of underwater vehicles, of the generic type defined in the precharacterizing clause of claim 1.

A known side antenna for submarines (EP 0 214 525 B1) is formed by a so-called hydrophone streamer which is held over its longitudinal extent at a distance from the submarine casing, by holding elements which are attached to the submarine casing at a distance from one another. The hydrophone streamer has a flexible tube which is supported by moldings at specific intervals. The hydrophones, which are arranged at defined distances in the flexible tube, are each arranged between two moldings, which are supported on the casing of the flexible tube. The cylindrical hydrophones are in this case seated in a holder which is firmly clamped to tension cables. This holder is assembled from two resiliently flexible plastic halves, whose end sections, which each surround half of the tension cables, are held together by spring clips. The central part of the holder surrounds a cylindrical cavity, in which the hydrophone is held in a sprung manner. The flexible tube casing is filled with a liquid, preferably oil, which ensures good acoustic transmission characteristics between the hydrophones and the flexible tube casing.

A known underwater antenna (DE 198 12 356 C1) in the form of a so-called towed antenna has a flexible tube which is filled with a filler, in which a large number of hydrophones are arranged in a row one behind the other at a distance and are held approximately centrally in the flexible tube by being supported on the flexible tube casing. Moldings which are at a distance from one another in the longitudinal direction of the flexible tube and are composed of metal foam are provided in order to support the hydrophones, and the hydrophones are inserted centrally into them. The moldings are fixed to a tension cable, which passes through the flexible tube. The flexible tube is filled with oil.

In a likewise known underwater towed antenna (DE 195 18 461 C1), a gel is chosen as the filler which uniformly surrounds the hydrophones on all sides and thus fixes them essentially centrally in the flexible tube. The filler is a two-component silicone rubber, whose two components are in the form of thin liquids which can flow well, and which cure at room temperature to form a gel-like vulcanizate.

In one known underwater antenna (EP 0 654 953 B1), which is referred to as a so-called cylinder base, a large number (for example ninety six) of transducer arrangements in the form of rods, so-called staves, are mounted alongside one another on the outer casing of a hollow cylinder composed of glass-fiber-reinforced plastic. Each stave has a plurality (for example three) of hydrophones which are arranged at the same distance one above the other and are in the form of small spherical ceramics. A reflector is arranged behind the hydrophones in the sound incidence direction. The hydrophones and reflector are embedded in acoustically transparent hard encapsulation composed of polyurethane. The connecting lines for all of the hydrophones are passed to a common plug, which projects into a blind hole which is formed on one end face of the hard encapsulation. An underwater antenna such as this has a directional characteristic with a sufficiently narrow main lobe, in the vertical direction as well, on the basis of a plurality of hydrophones which are located vertically one above the other, with suitable signal processing of the hydrophone output signals.

The invention is based on the object of providing an underwater antenna of the type mentioned initially, which, in addition to a narrow main lobe of the reception characteristic which can be scanned in the horizontal direction, also has sufficiently good beam formation in the vertical direction and good reception sensitivity in the low-frequency range, and which furthermore can be produced easily from the production engineering point of view, and is simple to assemble.

SUMMARY OF THE INVENTION

According to the invention, the object is achieved by the feature in claim 1.

The electroacoustic underwater antenna according to the invention combines the acoustic advantages of a hydrophone streamer, in terms of its reception sensitivity in the low-frequency range, and the advantages of a cylinder base or of a flat antenna, in terms of their good beam formation in the vertical reception area. The mounting plate, which is stiff to bend, is at the same time used as a reflector and gives the underwater antenna a good back-to-front ratio. The production of the plastic body is very simple from the production engineering point of view, as is the insertion of the hydrophones into the cavities.

Expedient embodiments of the underwater antenna according to the invention together with advantageous developments and refinements of the invention are specified in the further claims.

According to one advantageous embodiment of the invention, a plurality of plastic bodies fitted with hydrophones are arranged alongside one another and/or one behind the other. Arranging the individual plate-like plastic bodies, so-called panels which contain hydrophones arranged in rows and columns, in a row is simple from the assembly point of view, and allows a flat antenna of any desired dimensions to be produced with little manufacturing effort.

According to one advantageous embodiment of the invention, the plastic body which is in the form of a panel is produced as hard encapsulation which encloses the plate which is stiff to bend, in which hard encapsulation channels which run parallel to one another are formed, in order to form the cavities in front of the plate surface and at a distance from it. An identical number of hydrophones are inserted into a closed, oil-filled flexible tube, and one flexible tube is drawn into each channel. The flexible tube is preferably manufactured from polyethylene. The use of oil as a filler results in a very good reception response in the low-frequency range, which is considerably better than, for example, in the case of hydrophones embedded in gel in hydrophone streamers.

According to one alternative embodiment of the invention, an identical number of hydrophones are in each case inserted directly into the channels which are formed in the hard encapsulation, on which channel walls are supported by means of normal moldings, and are fixed such that they cannot move axially. The channels are preferably filled with oil and closed.

The invention will be described in more detail in the following text using one exemplary embodiment, which is illustrated in the drawing in which, illustrated schematically:

DETAILED DESCRIPTION OF THE INVENTION

Figure 1:
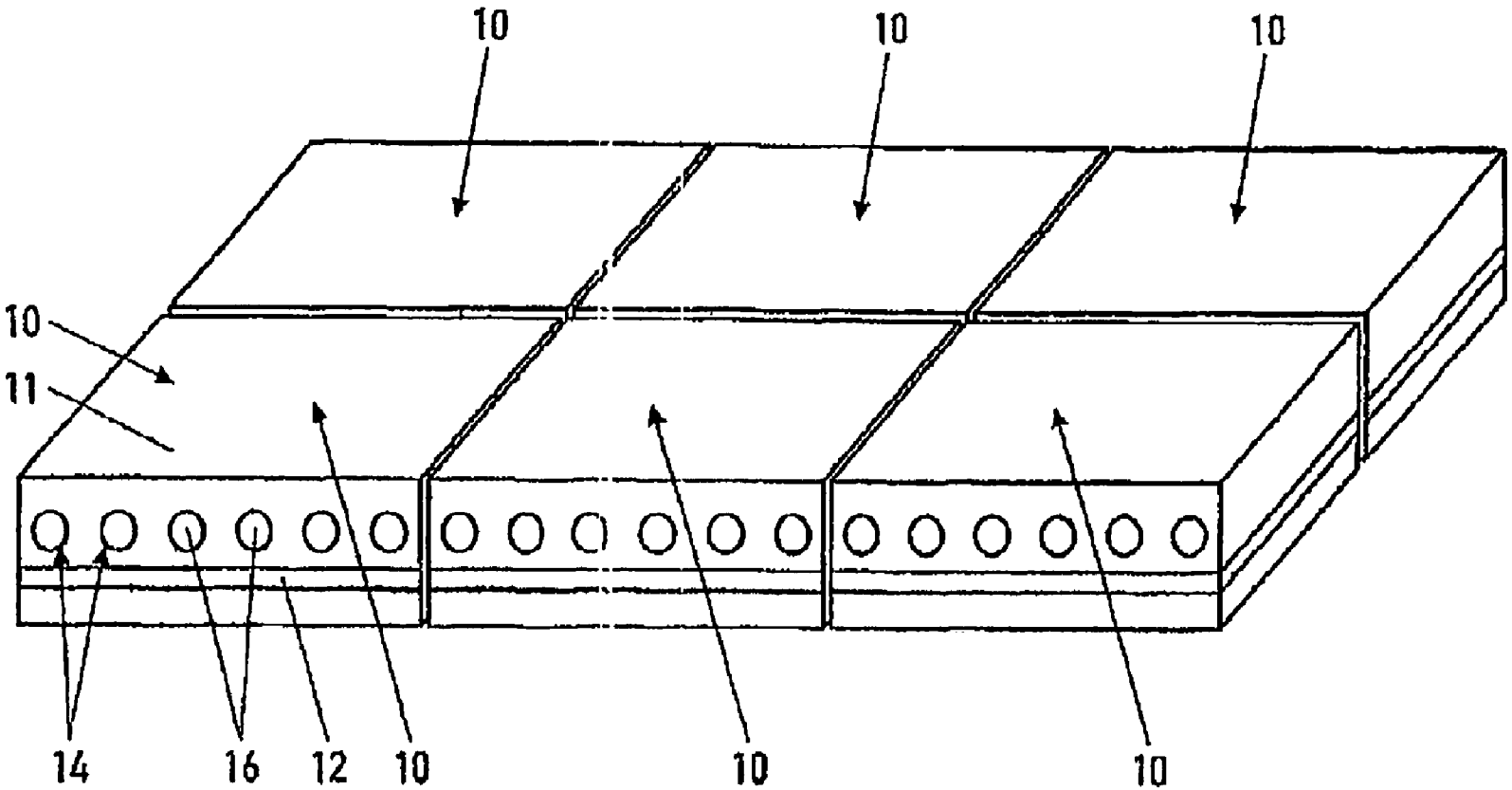
FIG. 1 shows a flat electroacoustic underwater antenna which is composed of a plurality of antenna elements.

The electroacoustic underwater antenna which is illustrated in perspective form in FIG. 1 is a flat antenna which is preferably used as a side antenna mounted on the outer skin of an underwater vehicle. It is composed of a plurality of panel-like antenna elements 10, which are arranged one behind the other and/or alongside one another and are individually attached to the outer skin of the underwater vehicle. Each antenna element 10 has an acoustically transparent, plate-like plastic body 11 which, on the one hand, contains a plate 12 which is stiff to bend, and on the other hand contains hydrophones 13, which are arranged in front of the plate 12 in the sound incidence direction and are arranged in cavities 14, which are contained in the plastic body 11 and extend separated from one another but parallel and toward the plate 12. The cavities 14 are closed and filled with oil which, because of its advantageous acoustic characteristics, is preferred to other fillers, such as gel. This design arrangement of the hydrophones 13 results in each antenna element 10 forming a panel with a hydrophone arrangement in which the hydrophones 13 are positioned in rows and columns. By way of example, six cavities 14 which are located alongside one another, separated from one another but parallel, each accommodate six hydrophones 13 which are separated from one another, thus resulting in a flat hydrophone arrangement of 6×6=36 hydrophones 13.

Figure 2:
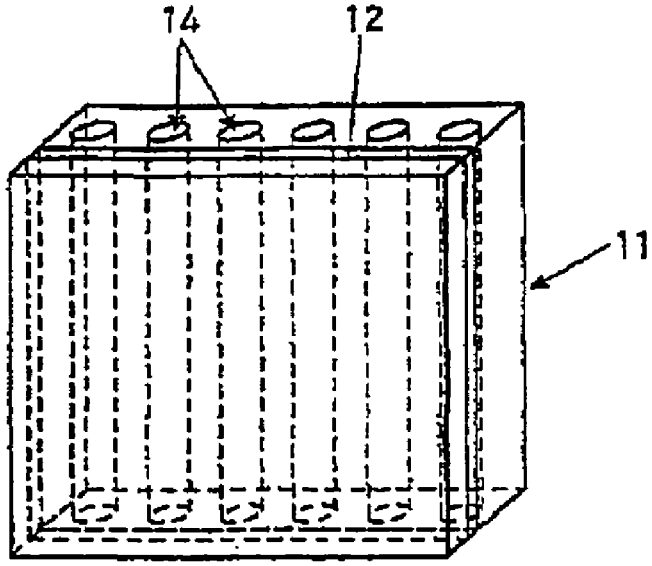
FIG. 2 shows a perspective view of hard encapsulation with an embedded plate, which is stiff to bend, and channels formed in it in order to produce an antenna element.

The plastic body 11 is produced as hard encapsulation which surrounds the plate 12 which is stiff to bend, in which the cavities 14 are formed as hard encapsulation channels (FIG. 2) which run parallel to one another in front of the plate surface, but at a distance from it. The hard encapsulation is composed of an essentially viscous elastomer, preferably polyurethane, which can be processed using a casting method.

Figure 3:
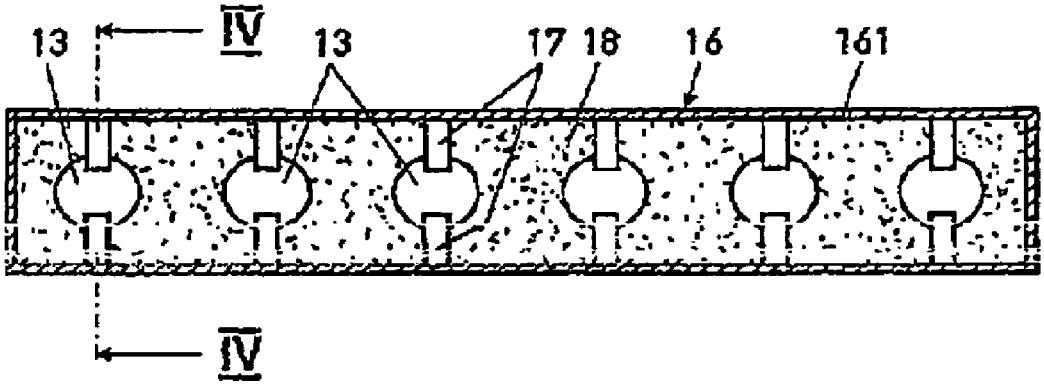
FIG. 3 shows a longitudinal section through a hydrophone flexible tube for drawing into a channel in the hard encapsulation shown in FIG. 2.
Figure 4:
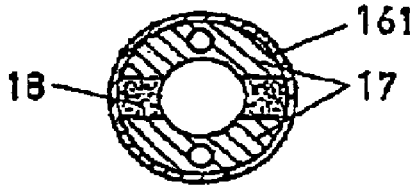
FIG. 4 shows a section along the line IV-IV in FIG. 3.

An identical number of hydrophones 13, in the illustrated example six hydrophones 13, are inserted into a closed, oil-filled flexible tube 16 and are fixed in the flexible tube 16 such that they cannot move axially at a radial distance from the flexible tube sleeve 161, with the distance between the successive hydrophones 13 being constant (FIG. 3). The hydrophones 13, which are in the form of small spherical ceramics, are for this purpose each accommodated in a plastic holder 17, which is supported on the flexible tube sleeve 161 and is fixed such that it cannot be moved axially. The oil filling 18 is indicated by dots in FIG. 3. A hydrophone flexible tube 16, which is being formed as described above, is in each case drawn into one cavity or channel 14 in the hard encapsulation, so that six hydrophone flexible tubes 16 are drawn in if there are a total of six channels 14, thus forming a transducer arrangement of 6×6=36 hydrophones 13. By way of example, the plastic holders 17 with the hydrophones 13 can be introduced by the plastic holders 17 being fixed in a very coarse mesh, and by the mesh with the fixed hydrophones 13 being floated into the flexible tube 16.

Alternatively, the hydrophones 13 can be inserted by means of their plastic holders 17 directly into the channels or cavities 14, at the defined distance from one another. The channels 14 fitted with hydrophones 13 in this way are filled with oil and are closed at the end.

The electrical cables for carrying signals and for supplying power which lead to the hydrophones 13 have not been shown in the illustration, for the sake of clarity.

The invention claimed is:

1. An electroacoustic underwater antenna, in particular a side antenna which can be fitted to the outer skin of underwater vehicles, having hydrophones which are arranged in a row one behind the other at a fixed distance from one another in at least one elongated, closed cavity which is filled with a filler, and wherein:

a plurality of cavities, which are fitted with hydrophones, extend separated from one another but parallel in front of and at a distance from a surface of a flat plate which is stiff to bend; the plate and the cavities are embedded in an acoustically transparent plastic body which has a flat panel shape; a plurality of said acoustically transparent plastic bodies fitted with hydrophones are arranged alongside one another and/or one behind the other; and each acoustically transparent plastic body is formed of a hard encapsulation that surrounds the flat plate which is stiff to bend, and in which hard encapsulation channels, which run parallel to one another and contain the hydrophones and the filler which is a material different from the hard encapsulation, are provided in order to form the cavities in front of and at a distance from the surface of the flat plate.

2. The underwater antenna as claimed in claim 1, wherein an identical number of hydrophones inserted into a closed flexible tube filled with the filler is disposed in each said channel.

3. The underwater antenna as claimed in claim 2, wherein the flexible tube is composed of polyethylene.

4. The underwater antenna as claimed in claim 1, wherein an identical number of hydrophones are inserted directly into each of the channels, and the channels are filled with the filler and closed at their ends.

5. The underwater antenna as claimed in claim 1 wherein the filler is oil.

6. The underwater antenna as claimed in 1, wherein the hard encapsulation is composed of an essentially viscous elastomer which can be processed using a casting method.

7. The underwater antenna as claimed in claim 1, wherein the plate which is stiff to bend is composed of metal.

8. The underwater antenna as claimed in claim 1, wherein the hydrophones are formed by spherical ceramics.

9. The underwater antenna as claimed in claim 6, wherein the hard encapsulation is polyurethane.

* * * * *